US008133570B2

(12) United States Patent
Fujisawa et al.

(10) Patent No.: US 8,133,570 B2
(45) **Date of Patent: *Mar. 13, 2012**

(54) SHEET MATERIAL EXCELLING IN CUSHION AND NONSLIP PROPERTIES

(75) Inventors: Michinori Fujisawa, Okayama (JP); Sadahiro Ishii, Osaka (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 1378 days.

This patent is subject to a terminal disclaimer.

(21) Appl. No.: 11/578,104

(22) PCT Filed: Apr. 1, 2005

(86) PCT No.: PCT/JP2005/006494

§ 371 (c)(1),
(2), (4) Date: Jan. 22, 2007

(87) PCT Pub. No.: WO2005/097268

PCT Pub. Date: Oct. 20, 2005

(65) Prior Publication Data

US 2007/0232165 A1 Oct. 4, 2007

(30) Foreign Application Priority Data

Apr. 9, 2004 (JP) ..... 2004-115488

(51) Int. Cl.

| | |
|---|---|
| ***A63B 41/00*** | (2006.01) |
| ***A63B 39/00*** | (2006.01) |
| ***A63B 43/02*** | (2006.01) |
| ***D06N 7/04*** | (2006.01) |
| ***G11B 5/64*** | (2006.01) |
| ***B32B 3/00*** | (2006.01) |

(52) U.S. Cl. ..... 428/141; 428/156; 473/596; 473/597; 473/604; 473/607

(58) Field of Classification Search ..... 428/141, 428/156, 151, 187, 206, 207, 904; 473/604–606, 473/596, 597, 599

See application file for complete search history.

(56) References Cited

U.S. PATENT DOCUMENTS

| | | | | |
|---|---|---|---|---|
| RE14,832 | E * | 3/1920 | Saunser | 473/604 |
| 3,256,019 | A | 6/1966 | Barton | |
| 4,000,894 | A | 1/1977 | Butzen | |
| 4,991,842 | A | 2/1991 | Finley | |
| 5,091,265 | A | 2/1992 | Kennedy et al. | |
| 5,518,234 | A | 5/1996 | Palmquist | |
| 5,669,838 | A | 9/1997 | Kennedy et al. | |
| 6,159,581 | A * | 12/2000 | Yoneda et al. | 428/195.1 |
| 7,758,458 | B2 * | 7/2010 | Fujisawa et al. | 473/597 |

FOREIGN PATENT DOCUMENTS

| | | |
|---|---|---|
| JP | 2000 273769 | 10/2000 |
| JP | 2000 328465 | 11/2000 |
| TW | M247241 | 12/2003 |

OTHER PUBLICATIONS

International Search Report issued Sep. 16, 2010 in EP Application No. 05727750.1.
Office Action issued Oct. 5, 2010, in Japanese Patent Application No. 2006-512061.
Office Action issued Oct. 15, 2010, in Taiwan Patent Application No. 09920730810 (with English translation of Category of Cited Documents).

* cited by examiner

*Primary Examiner* — Catherine A Simone
(74) *Attorney, Agent, or Firm* — Oblon, Spivak, McClelland, Maier & Neustadt, L.L.P.

(57) ABSTRACT

The present invention provides a sheet material exhibiting an appearance excellent in three dimensional feel in combination with sufficient abrasion strength of the surface, cushioning property and non-slipping property and advantageously used as the surface material of balls for basketball and the like. The sheet material has a base fabric and a coating layer of a polymer covering the surface of the base fabric, where the coating layer has substantially continuous protrusions and hemispherical depressions formed adjoining the protrusions on a surface, the depressions have a color tone different from a color tone of the protrusion and a gloss brighter than a gloss of the protrusion, a vertical projected area of the depression is 3 to 30 $mm^2$, an average distance between the depressions is 0.5 to 3 mm, and a height difference between the protrusion and the depression is 50 to 1,000 μm.

17 Claims, No Drawings

SHEET MATERIAL EXCELLING IN CUSHION AND NONSLIP PROPERTIES

TECHNICAL FIELD

The present invention relates to a sheet material excelling in cushion and non-slipping properties. More particularly, the present invention relates to a sheet material exhibiting an appearance excellent in the three dimensional feel in combination with sufficient abrasion strength of the surface, cushioning property and non-slipping property and advantageously used as the covering material for sporting goods such as balls for basketball.

BACKGROUND ARTS

Various properties are required for a ball such as a basketball, a handball, a rugby ball, or an American football. For example, surface abrasion resistance at high level is required for a surface material subjected to repeated rubbing or collision with a hand, a floor, or the like. Further, in a case where a ball is brought into direct contact with a hand, soft cushioning property is required for reducing impact on fingertips in catching of the ball.

Various processes have been proposed heretofore as the process for obtaining a sheet material exhibiting the excellent cushioning property as the surface material of a ball and a leather-like appearance and feel as the taste.

For example, there are proposed: a leather-like sheet at least including 4 layers of a nonporous elastic polymer layer (first layer), a porous elastic polymer layer (second layer), a layer formed of an elastic polymer and a nonwoven fabric (third layer), and a nonwoven fabric layer (fourth layer); and a ball formed of the leather-like sheet (see Patent Document 1). However, in a method of Patent Document 1, the first and second layers were formed by using elastic polymers each having durability for practical use to provide a ball which had insufficient cushioning property and which could not be suitably used as a ball for sports such as a basketball.

Further, in addition to cushioning property, there is proposed, as a leather-like sheet excellent in the three dimensional feel, synthetic leather having a transparent nonporous layer containing polyurethane as a main ingredient laminated on a surface of a base fabric covered with a polyurethane layer and having a pattern of protrusions and depressions. The synthetic leather has an air layer between the depressions and the nonporous layer, and a total area of bonding parts between the protrusions and the nonporous layer accounts for 50 to 90% of a surface area of the synthetic layer (see Patent Document 2). However, even in Patent Document 2, a ball having both cushioning property and durability for practical use and used as a ball handled by a hand such as a basketball has not yet been obtained.

A material for balls absorbing sweat in which a coating layer of a polyurethane coagulated in accordance with a wet process is laminated to the surface of a fibrous material comprising a polyurethane, pluralities of protrusions and depressions disposed between the protrusions are present on the surface of the coating layer, and the side face of the protrusions has an opening, is proposed (see Patent Reference 3). However, dirt tends to be attached to the material of Patent Reference 3. The non-slipping effect extremely decreases after a long use due to accumulation of dirt, and the material cannot be used practically. The soft cushioning property is not satisfactory, either.

Further, there is proposed a basketball having numerous polygonal recesses on an outer surface (see Patent Document 4). However, such polygonal recesses cause a ball formed of a sheet containing a base fabric to have poor softness, cushioning property, and feel. Further, the ball has problems in that abrasion resistance in collision with a ground is reduced and that a ball surface gets dirty easily.

In addition, there is proposed a basketball having numeral specific dimples on an outer surface (see Patent Document 5). According to Patent Document 5, the dimples have a height difference between projections and recesses of 200 to 500 μm, a vertical projected area of each of adjoining recesses of 79 to 314 $mm^2$ (diameter of 10 to 20 mm), and an average distance between the recesses of 8 to 16 mm (5/16 to 5/8 inches). However, such large dimples cause a ball formed of a sheet containing a base fabric to have problems such as reduced abrasion resistance, and poor cushioning property and non-slipping property.

Development of a sheet material exhibiting the soft cushioning property of a level higher than that heretofore exhibited in combination with the abrasion strength of the surface and the non-slipping property sufficient for the surface material of a ball for a ball game has been desired.

[Patent Document 1]: Japanese Patent Application Laid-Open No. 2000-102629

[Patent Document 2]: Japanese Patent Application Laid-Open No. Heisei 11 (1999)-93081

[Patent Document 3]: The U.S. Pat. No. 6,024,661

[Patent Document 4]: The U.S. Pat. No. 4,991,842

[Patent Document 5]: The U.S. Pat. No. 5,518,234

DISCLOSURE OF THE INVENTION

In view of the above circumstances, it is an object of the present invention to provide a sheet material which has a sufficient surface abrasion property and a non-slipping property sufficient for the surface material of a ball for a ball game in combination with an appearance excellent in the three dimensional feel and is advantageously used as the cover material of balls for ball games exhibiting the soft cushioning property than ever before.

As the result of intensive studies by the present inventors to achieve the above object, it was found that the above object could be achieved by arranging on the surface substantially continuous protrusions and depressions having a color tone different from that of the protrusions and a gloss brighter than that of the protrusion in a manner such that specific relations were satisfied. The present invention has been completed based on the knowledge.

Therefore, the present invention provides a sheet material comprising a base fabric and a coating layer of a polymer covering a surface of the base fabric, wherein the coating layer has substantially continuous protrusions and hemispherical depressions formed adjoining the protrusions on a surface, the depression has a color tone different from a color tone of the protrusion and a gloss brighter than a gloss of the protrusion, a vertical projected area of the depression is 3 to 30 $mm^2$, an average distance between the depressions is 0.5 to 3 mm, and a height difference between the protrusion and the depression is 50 to 1,000 μm.

Since the sheet material of the present invention has on the surface of the sheet substantially continuous protrusions and hemispherical depressions having a color tone different from that of protrusions and a gloss brighter than that of protrusions, the sheet material has the abrasion strength of the surface sufficient for the surface material of a ball for a ball game and exhibits the excellent cushioning property enabling decreasing impact to finger tips when the ball is caught and the excellent non-slipping property due to excellent fitting of the finger tips with the three dimensional shape formed with the protrusions and the depressions while the appearance excellent in the three dimensional feel is exhibited.

Therefore, the sheet material of the present invention can be advantageously applied to balls which are brought into direct contact with hands such as balls for a basketball, a handball, a rugby football and an American football, grip tapes for tennis racquets and badminton racquets and surface covers for steering wheels for vehicles, holding straps and handrails of staircases.

THE MOST PREFERRED EMBODIMENT TO CARRY OUT THE INVENTION

As the base fabric used for the sheet material of the present invention, various base fabrics such as natural leather, knitted fabric, woven fabric and nonwoven fabric can be used. When the knitted fabric, woven fabric, nonwoven fabric, or the like is used as a base fabric, the base fabric may be impregnated with a polymer as required. Any known leather-like sheets may be used as the base fabric. Of those, a leather-like base fabric formed of a fiber-entangled fabric and a polymer is preferable, and a base fabric having a three-dimensionally entangled nonwoven fabric, which is used as a fiber-entangled fabric, impregnated with a spongy polymer is particularly preferable. This is because depressions adjoining the continuous protrusions on the sheet material surface fit well with the fingertips grasping a ball, and the sheet surface has soft touch and texture, and a cushioning property to a certain extent, to thereby improve the non-slipping property.

Any known natural fiber, synthetic fiber, or semisynthetic fiber may be used as a fiber constituting the knitted fabric, woven fabric, nonwoven fabric, or the like used as a base fabric, as long as mechanical properties required for a surface material of a ball can be satisfied. Industrially known cellulose-based fiber, acrylic fiber, polyester-based fiber, polyamide-based fiber, or a mixture thereof is preferably used from the viewpoints of quality stability, cost, and the like. In the present invention, though not particularly limited, a microfine fiber capable of realizing a soft texture similar to that of natural leather is preferable. A microfine fiber having an average fineness of 0.3 dtex or less, more preferably 0.1 dtex or less, and 0.0001 dtex or more is preferably used.

Examples of a method of forming microfine fibers described above include: (a) a method involving direct spinning of microfine fibers having an intended average fineness; and (b) a method involving spinning of microfine fiber-forming fibers having a fineness larger than the intended fineness, and then conversion of the microfine fiber-forming fibers into microfine fibers having the intended average fineness.

In the method (b) of forming microfine fibers by way of microfine fiber-forming fibers, the microfine fibers are generally formed by composite spinning or mix spinning two or more types of incompatible thermoplastic polymers. Then, at least one polymer component of the fibers is removed through extraction or decomposition, or polymers are segmented or split along a boundary between the component polymers. Typical examples of the microfine fiber-forming fibers from which at least one polymer component is removed include so-called "sea/island fibers" and "multi-layered fibers".

In the sea/island fibers, a sea component polymer is removed through extraction or decomposition, and in the multi-layered fibers, at least one layer component polymer is removed through extraction or decomposition, to thereby obtain microfine fiber bundles formed of the remaining island component. Typical examples of the microfine fiber-forming fibers segmented or split along the boundary between the component polymers include so-called petal-like layered fibers and multi-layered fibers, which are split from each other along the boundary between layers of different polymers into microfine fiber bundles through physical treatment or chemical treatment.

The island component polymer for the sea/island fibers or multi-layered fibers is preferably a polymer which can be subjected to melt spinning and is capable of exhibiting sufficient fiber physical properties such as strength. The island component polymer preferably has a melt viscosity higher than that of the sea component polymer under spinning conditions and a large surface tension. Examples of the island component polymer described above include: polyamide-based polymers such as nylon-6, nylon-66, nylon-610, and nylon-612; polyamide-based copolymers thereof; polyester-based polymers such as polyethylene terephthalate, polypropylene terephthalate, polytrimethylene terephthalate, and polybutylene terephthalate; and polyester-based copolymers thereof.

The sea component polymer for the sea/island fibers or multi-layered fibers is preferably a polymer which has a melt viscosity lower than that of the island component polymer, exhibits dissolution and decomposition behaviors different from those of the island component, has a high solubility in a solvent, a decomposer, or the like used for dissolving or removing the sea component, and has a low compatibility with the island component. Examples of the sea component polymer suitably used include polyethylene, modified polyethylene, polypropylene, polystyrene, modified polystyrene, and modified polyester.

The microfine fiber-forming fibers for suitably forming microfine fibers having a fineness of 0.3 dtex or less, that is, the sea/island fibers have a suitable sea/island volume ratio (sea component/island component) of 30/70 to 70/30, and preferably 40/60 to 60/40. When the volume ratio of the sea component is less than 30%, the resulting leather-like sheet is hardly sufficiently flexible because the amount of the sea component to be removed through dissolution or decomposition by using a solvent or decomposer is too small, thus requiring the use of a treating agent such as a softening agent in an excess amount. However, the use of an excess amount of the treating agent is not preferable because it may cause various problems such as deterioration in mechanical properties such as tear strength, adverse effects on other treating agents, adverse effects on touch, and poor durability. When the volume ratio of the sea component exceeds 70%, the resulting leather-like sheet hardly has stably ensured mechanical properties at a sufficient level for a base material for a ball because the absolute amount of the fibers formed of the island component obtained after removal through dissolution or decomposition is too small. In addition, a large amount of the component to be removed through dissolution or decomposition may cause problems such as variation in quality due to removal failure, and disposal of removed components in large amounts. Further, a large amount thereof is not appropriate from the viewpoint of productivity with respect to production speed, production cost, or the like, and thus is not industrially desirable.

A method of producing the three-dimensionally entangled nonwoven fabric suitably used as a fiber-entangled fabric is not particularly limited, and the three-dimensionally entangled nonwoven fabric can be produced through any known method providing appropriate weight or density for a base material for a ball. Examples of the fabric to be used include: nonwoven fabric formed of staples; and nonwoven fabric formed of filaments. A method of forming a web may employ any known methods such as carding, paper-making, and spun-bonding. The web is entangled through a known method such as needle-punching or spun-lacing alone or in combination.

Of the methods, the three-dimensionally entangled nonwoven fabric is in particular preferably produced through the following method. Spun fibers are drawn at a draw ratio of about 1.5 to 5 times, mechanically crimped, and then cut into staples of about 3 to 7 cm long each. The staples are then carded and formed into a web having a desired density by passing through a webber. The obtained web is laminated to have a desired weight and needle-punched at about 300 to 4,000 punches/$cm^2$ by using a single- or multi-barb needle to entangle fibers in a thickness direction.

Next, the obtained fiber-entangled fabric such as the three-dimensionally entangled nonwoven fabric is impregnated with a polymer as required. The fiber-entangled fabric is impregnated with a solution or dispersion of the polymer through any known method such as dip-nipping, knife-coating, bar-coating, roll-coating, and spray-coating alone or in combination, and then the polymer is dry- or wet-coagulated into a spongy form having numerous voids.

Any known polymers generally used for production of a leather-like sheet may be used as the polymer. Preferable examples of the polymer include a polyurethane-based resin, a polyester-based elastomer, a rubber-based resin, a polyvinyl chloride resin, a polyacrylic acid-based resin, a polyamino acid-based resin, a silicon-based resin, modified products thereof, copolymers thereof, and mixtures thereof.

The polymer in an aqueous dispersion or organic solution is impregnated into the fiber-entangled fabric, and is coagulated into a spongy form mainly through dry-coagulation for the aqueous dispersion or through wet-coagulation for the organic solution. When the aqueous dispersion is used, a heat-sensitive gelling agent is preferably added, to thereby allow uniform coagulation of the elastic polymer in a thickness direction through dry-coagulation, or through dry-coagulation combined with steaming, far infrared heating, or the like. When the organic solution is used, a coagulation modifier is preferably used in combination, to thereby form more uniform voids. The polymer impregnated into the fiber-entangled fabric, especially the three-dimensionally entangled nonwoven fabric, is coagulated into a spongy form, to thereby obtain a base material having a natural leather-like texture and various physical properties suitable for a material for a ball.

In the present invention, a polyurethane-based resin is preferably used as the polymer impregnated into the fiber-entangled fabric from the viewpoints of a well-balanced texture and well-balanced physical properties of the resulting fiber-entangled fabric in a composite state.

Typical examples of the polyurethane-based resin are those produced through a reaction in a predetermined molar ratio of: at least one polymer diol having an average molecular weight of 500 to 3,000 selected from the group consisting of polyester diol, polyether diol, polyester ether diol, polylactone diol, and polycarbonate diol; at least one organic diisocyanate selected from the group consisting of aromatic, alicyclic, and aliphatic organic diisocyanates such as tolylene diisocyanate, xylene diisocyanate, phenylene diisocyanate, 4,4'-diphenylmethane diisocyanate, 4,4'-dicyclohexylmethane diisocyanate, isophorone diisocyanate, and hexamethylene diisocyanate; and at least one chain extender selected from the group consisting of low molecular compounds having at least two active hydrogen atoms such as diols, diamines, hydroxylamines, hydrazines, and hydrazides. Polyurethane may be used as a mixture of two or more types thereof, or may be used as a polymer composition obtained by adding a polymer such as synthetic rubber, polyester elastomer, or polyvinyl chloride as required.

When the microfine fiber-forming fibers are used as the fiber, a composite sheet obtained after impregnation and coagulation of the solution or dispersion of the polymer, or a fiber sheet before impregnation and coagulation of the solution or dispersion of the elastic polymer is subjected to microfine fiber formation. Thus, the microfine fiber-forming fibers are converted into microfine fiber bundles, to thereby obtain a leather-like base fabric formed of the microfine fiber-entangled fabric and the polymer. When the composite sheet, in particular, the sea/island fiber is subjected to microfine fiber formation, the sea component polymer is removed to form voids between microfine fiber bundles and the polymer to weaken the binding of the microfine fiber bundles by the polymer. Thus, the leather-like base fabric tends to have a softer texture. Therefore, the composite sheet (after impregnation and coagulation of the polymer) is preferably subjected to microfine fiber formation in the present invention.

In contrast, when the fiber sheet is subjected to microfine fiber formation, the microfine fiber bundles are strongly bound by the polymer and the leather-like base fabric tends to have a harder texture. However, the tendency of having a harder texture can be sufficiently suppressed by reducing the ratio of the polymer in the leather-like base fabric. Therefore, the fiber sheet (before impregnation and coagulation of the polymer) is preferably subjected to microfine fiber formation for obtaining dense and hard texture with a higher ratio of fibers.

The thickness of the base fabric for a surface material of a ball, for example, may be arbitrarily selected in accordance with the type or required physical properties of the ball, the texture of the ball preferred by a player, and the like. The thickness thereof is preferably 0.4 to 3.0 mm, though not particularly limited thereto. When the thickness of the base fabric is less than 0.4 mm, minimum essential mechanical properties such as tensile strength, tear strength, and abrasion resistance may be hardly ensured. In contrast, when the thickness of the base fabric exceeds 3.0 mm, there are no particular disadvantages in mechanical properties as a material, and cushioning property tends to rather improve. However, the thickness exceeding 3.0 mm is not preferable because the weight of the ball itself increases.

The mass ratio of the fibers to the polymer in the base fabric may be arbitrarily selected for adjusting physical properties or texture, and is not particularly limited in the essential significance of the present invention. For example, a base fabric having a generally preferred leather-like texture as a material for a ball has a mass ratio of fibers/polymer of generally 35/65 to 65/35, preferably 40/60 to 60/40 when the composite sheet is subjected to microfine fiber formation, or a mass ratio thereof of generally 65/35 to 95/5, preferably 60/40 to 90/10 when the fiber sheet is subjected to microfine fiber formation.

The sheet material of the present invention comprises a cover layer of a polymer formed on a surface of the base fabric. Various methods can be employed for forming a cover layer formed of a polymer on the surface of the base fabric. An example of the method involves: continuous application of a dispersion, solution, or melt of a polymer onto a surface of a base fabric in an amount determined by a predetermined clearance between the surface of the base fabric and a knife, bar, roller, or the like; and drying of the polymer into a film form or dry-coagulation of the polymer into a porous form and drying, wet-coagulation of the polymer into a porous form and drying, or melt formation.

In the present invention, when continuous protrusions are formed on a polymer cover layer by using an emboss roller, flat emboss plate, or the like, the polymer layer is preferably in a porous form obtained through dry- or wet-coagulation and drying. Alternatively, when continuous protrusions are formed on an polymer cover layer by transfer using release paper, the polymer layer is preferably dry- or wet-coagulated and dried from the viewpoint of surface touch and texture, though not particularly limited thereto. When dispersion is used, a coagulation and drying method generally involves: use of an additive such as a foaming agent; and successive dry-coagulation and drying. When a solution is used, a coagulation and drying method generally involves: application of a treating agent containing a poor solvent of a polymer, or immersion in a treating bath containing a poor solvent of a polymer; and coagulation of the polymer into a porous form.

When the base fabric formed of a fiber-entangled fabric and a polymer is used as the base fabric, a method of simultaneously completing coagulation of a polymer to be impregnated into a base fabric and coagulation of a polymer for forming a cover layer is preferably employed in the present invention. Thus, the drying after the coagulation can be performed in one step, and the base fabric and the polymer cover layer (porous surface layer) are integrally bonded in the obtained leather-like sheet.

Another method of forming the polymer cover layer on the surface of the base fabric involves: application of a predetermined amount of dispersion or solution of a polymer on a transfer sheet such as a film or release paper once; drying of the polymer into a film form, or coagulation of the polymer into a porous form and drying in the same manner as described above; integrally bonding the obtained film to the base fabric through an adhesive, or through re-dissolution by using a treating liquid containing a solvent of the polymer; and peeling off the transfer sheet. Still another method thereof involves: application of a predetermined amount of dispersion or solution of a polymer onto a transfer sheet once; and attaching of the transfer sheet with a base fabric before or during the drying and coagulation of the polymer, to thereby integrally bond the polymer layer and the base fabric upon coagulation.

The polymer forming a cover layer is preferably a resin capable of providing non-slipping property to some extent, not a resin having slip property as a resin itself. Examples of the resin that can be used include synthetic rubber, polyester elastomer, polyvinyl chloride, and a polyurethane-based resin. Of those, a polyurethane-based resin is preferably used as the polymer impregnated into the fiber-entangled fabric from the viewpoint of a balance among elasticity, softness, abrasion resistance, ability of forming a porous form, and the like.

Various polyurethane-based resins as described above may be used as the polyurethane-based resin. Polyurethane may be used as a mixture of two or more types thereof, or may be used as a polyurethane polymer composition obtained by adding a polymer such as synthetic rubber, polyester elastomer, or polyvinyl chloride as required. As polyurethane mainly used, a resin formed of polyether-based polymer diol represented by polytetramethylene glycol is preferably used from the viewpoints of hydrolysis resistance, elasticity, and the like.

The solution or dispersion of the polymer to be applied onto the base fabric may arbitrarily include an additive such as a colorant, a light stabilizer, or a dispersant alone or in combination of two or more types thereof added in accordance with the purpose. Other additives such as a coagulation modifier for wet-coagulation may be arbitrarily selected as required and preferably added alone or in combination of two or more types thereof to control the porous form, in addition to the foaming agent for dry foaming.

When polyurethane is used as the polymer, a solution containing polyurethane as a main ingredient is applied onto the base fabric and the whole is immersed in a treating bath containing a poor solvent of polyurethane, to thereby coagulate polyurethane into a porous form. Water is preferably used as a typical poor solvent of polyurethane. However, a good solvent of polyurethane such as dimethylformamide is mixed with water which is a poor solvent as a treating bath, and a mixing ratio thereof is arbitrarily set, to thereby allow control of a coagulated state, that is, a porous form or pattern and result in a preferably employed method.

The sheet material of the present invention comprises the base fabric and the coating layer of the polymer covering a surface of the base fabric, wherein the coating layer has substantially continuous protrusions and hemispherical depressions (hereinafter, occasionally referred to simply as depressions) formed on the surface.

Here, the phrase "substantially continuous protrusions" refers to a surface state in which the protrusions are formed on a periphery of depressed shapes (depressions) transferred by pressing a plurality of protruded shapes from the surface side at intervals on a flat sheet surface, for example.

A method of forming a coating layer of a polymer having "substantially continuous protrusions" may employ any known method as long as the desired pattern of protrusions and depressions can be provided stably. For example, the method of forming a coating layer of a polymer having "substantially continuous protrusions" may employ: a method involving embossing of a surface of a sheet material having at least the coating layer with a polymer by using an emboss roller or the like having the desired pattern of protrusions and depressions; and a method involving formation of a polymer layer by casting and solidifying a polymer liquid on release paper having the desired pattern of protrusions and depressions, and use of the polymer layer as a surface layer for the sheet material.

It is required that the depressions formed adjoining the protrusions each have a vertical projected area of 3 to 30 $mm^2$, and that an average distance between the depressions is 0.5 to 3 mm. In addition, it is required that a height difference between the protrusions and the depressions is 50 to 1,000 μm. Examples of a method of forming the depressions include: a method involving formation of the protruded shapes by using an emboss roller; and a method involving formation of protruded shapes by using a flat emboss plate having a similar shape or release paper. However, the method involving the use of the flat embosses plate is not suitable for mass production. The method involving the use of the release paper provides a height difference between the protrusions and depressions substantially limited to 200 to 300 μm. The pattern of protrusions and depressions tends to lack sharpness with a height difference close to the limit. In order to improve the sharpness, the release paper must be pressed at a larger pressing force, and a texture of the sheet tends to be harder. Thus, of those, a method involving formation of the protruded shapes by using an emboss roller is preferable.

When predetermined protrusions are formed by using an emboss roller, the protrusions may be formed by arbitrarily setting conditions such as an emboss depth of the roller to be used, a roller temperature, an embossing pressure, and embossing time. The conditions are not particularly limited, but the desired embossed depth may be obtained by adjusting: the emboss depth of the roller within a range of 80 to 1,100 μm; the roller temperature within the range of 150 to 180° C.;

the embossing pressure within the range of 5 to 50 kg/cm; and the embossing time within the range of 10 to 120 seconds.

A surface pattern of a ball used for a ball game such as a basketball must at least allow fingertips to be in contact with protrusions when a player grasps the ball randomly. Thus, as the pattern of the ball surface, a height difference between the protrusions and the depressions formed adjoining the protrusions is 50 to 1,000 μm, preferably 70 to 500 μm. When the height difference is less than 50 μm, favorable non-slipping property is hardly provided because a force of the fingertips is dispersed uniformly over the surface of the ball when the ball is grasped by a palm. When the height difference exceeds 1,000 μm, favorable non-slipping property is provided, but abrasion resistance of the ball may be reduced. In the present invention, the phrase "height difference between the protrusions and the depressions" refers to a value obtained by: measuring height differences between the highest part of the protrusions and the deepest part of the hemispherical depressions adjoining the protrusions at 10 points from cross section photographs; and averaging the measured values of the 10 points.

Further, in the sheet material of the present invention, a vertical projected area of each of the depressions is 3 to 30 $mm^2$, preferably 5 to 20 $mm^2$. When the vertical projected area exceeds 30 $mm^2$, favorable non-slipping property is provided, but abrasion resistance of the ball may be reduced. When the vertical projected area is less than 3 $mm^2$, favorable non-slipping property is hardly provided because the number of protrusions grasped by a fingertip increases and a force of the fingertip is dispersed uniformly over the surface of the ball when the ball is grasped by a palm. In the present invention, the phrase "vertical projected area of each of the depressions" refers to a vertical projected area of a depression region surrounded by boundaries with respect to the sheet material surface. In a pattern including hemispherical depressions and continuous protrusions observed in a cross section of the sheet material, a boundary between a protrusion and a depression refers to a part at an angle of 45° to a normal of the sheet surface if the pattern is curved, or refers to a corner if the pattern has corners.

A total area of vertical projected areas of the depressions is preferably 30 to 60%, more preferably 40 to 50% as a ratio with respect to a surface area of the sheet material. When the total area of the depressions is less than 30% as a ratio, favorable non-slipping property is hardly provided because the area and number of depressions grasped by a fingertip decrease when the ball is grasped by a palm. In contrast, when the total area of the depressions exceeds 60% as a ratio, favorable non-slipping property is provided, but abrasion resistance of the ball may be reduced. Here, the ratio of the total area of the vertical projected areas of the depressions with respect to the surface area of the sheet is obtained as a ratio per unit area by measuring vertical projected areas of the hemispherical depressions with an electron microscope.

Further, it is important that the depressions each have a hemispherical shape. Here, the term "hemispherical" refers not to a perfect hemispherical shape, but refers to a substantially hemispherical shape. The "hemispherical" shape in the present invention is preferably a three-dimensional shape having a smaller volume formed by cutting a sphere at a face not passing the center of the sphere. The depressions each have such a hemispherical shape, to thereby provide not only the durability and abrasion resistance of the three-dimensional shape itself which cannot be obtained with a non-hemispherical shape but also favorable non-slipping property by fitting to the shape of the fingertip.

Further, the average distance between the hemispherical depressions of the present invention must be 0.5 to 3 mm. When the average distance is less than 0.5 mm, softness, cushioning property, feel, and surface abrasion resistance may deteriorate because the depressions are too close to each other, to provide a partly, excessively sharp protrusion pattern. When the average distance exceeds 3 mm, fitting property and non-slipping property may deteriorate. The average distance between the depressions is preferably 1 to 2 mm.

The phrase "average distance between the depressions" refers to an average of values obtained by: photographing the surface with an electron microscope; selecting arbitrary 10 depressions; and measuring the shortest distance between the adjacent depressions from outer periphery of the depressions. A boundary between a protrusion and a depression refers to a part at an angle of 45° to a normal of the sheet surface if the pattern is curved as described above, or refers to a corner if the pattern has corners, and part surrounded by the boundaries is referred to as outer periphery.

Coloring treatment may be performed before or after the embossing treatment. In consideration of possible discoloration during the embossing treatment, the coloring treatment is preferably performed before the embossing treatment. Pigments are most preferably used as colorants from the viewpoints of heat resistance, light resistance, and fastness to rubbing. The coloring treatment may be performed through methods such as a gravure method, a dyeing method, a reverse coating method, and a direct coating method. The coloring treatment is most preferably performed through a gravure method from the viewpoints of productivity, cost, and the like.

The sheet material of the present invention provides excellent appearance having the three dimensional feel since the hemispherical depression has a color tone different from that of the continuous protrusions and a gloss brighter than that of the continuous protrusions. As the process for providing the depressions with a color tone different from that of the protrusions, a resin having a color tone different from that of the depressions is applied to the protrusions after the desired shape of protrusions and depressions is formed on the surface of the sheet. Specifically, the transcription using a gravure roll is preferable.

For providing the depressions with a gloss brighter than that of the continuous protrusions, the sectional shape itself is formed into a hemispherical shape and, moreover, the gloss at the protrusions and the depressions may be adjusted in accordance with necessity. Examples of the process for adjusting the gloss of the protrusions and the depressions include the process in which the smoothness of the surface of protrusions and depressions of the embossing roll or the release sheet used for providing the protrusions and the depressions is suitably adjusted to adjust the obtained gloss, and the process in which the protrusions are selectively coated with a resin having a gloss milder than the gloss of the depressions after the desired shape having protrusions and depressions is provided to the surface of the sheet material. As the latter process, specifically, the process of transcription using a gravure roll is preferable.

For example, a very small amount of carbon black is added to the ink used for coloring in the previous step to change the color tone in the direction of increasing blackness, and the obtained ink is transcribed to the protrusions only and dried to provide the depressions with a color tone different from that of the protrusions. Then, an ink containing a matting agent but not containing coloring agents is transcribed to the protrusions only in accordance with the gravure process and dried so that the gloss of the depressions is made conspicuous while the gloss of the protrusions is made milder.

In the present invention, the non-slipping property may be further enhanced as required through, for example: a method involving application of a resin having a non-slipping property over at least a part of continuous protrusions and depressions; or a method involving constitution of at least a part of protrusions and depressions with a resin having a non-slipping property. Preferable examples of the non-slip resin include a solvent-state polymer or an emulsion-state polymer such as; a resin obtained through homopolymerization or block copolymerization of a rubber-based monomer such as butadiene or isoprene; and an acrylic polymer obtained through homopolymerization or block copolymerization of an acrylic monomer or a urethane-based polymer. Other types of polymers may be used in combination with resins providing non-slipping property.

Furthermore, a known tackiness agent such as a polyterpene resin or a petroleum-based hydrocarbon resin may be added to the non-slip resin. Further, the non-slipping property may be adjusted by adding inorganic or organic particles, powder, or the like. Further, a softening agent, fillers, an antioxidant, and the like may be added to a surface resin in such amounts that surface abrasion resistance is not reduced.

Various methods may be used for a method of covering the protrusions on the sheet surface with a non-slip resin. The protrusions only are preferably covered with a non-slip resin through a method involving selective application of the non-slip resin. A specific example thereof is a method involving transfer of a non-slip resin by using a gravure roller. Both the protrusions and depressions are covered with a non-slip resin through a method involving application of the non-slip resin over the entire surface. Specific examples thereof include: a method involving application of a non-slip resin through spray coating; a method involving coating of a non-slip resin at a constant thickness over the entire surface through knife coating or the like; a method involving application of a non-slip resin over the entire surface of a base material such as process paper for film formation and bonding of the film onto a base material layer through an adhesive layer; and a method involving uniform extrusion of a non-slip resin over a base material from an extruder through an extrusion die for film formation on the surface thereof.

Since the sheet material of the present invention has on the surface of the sheet substantially continuous protrusions and hemispherical depressions having a color tone different from that of protrusions and a gloss brighter than that of protrusions, the sheet material has the abrasion strength of the surface sufficient for the surface material of a ball for a ball game and exhibits the excellent cushioning property enabling decreasing impact to finger tips when the ball is caught and the excellent non-slipping property due to excellent fitting of the finger tips with the three dimensional shape formed with the protrusions and the depressions while the appearance excellent in the three dimensional feel is exhibited. Therefore, The sheet material can be advantageously used as the cover material for the surface of balls directly brought into contact with hands such as a ball for basketball, grip tapes covering the gripping portion of racquets, steering wheels, hand straps, handrails of stairs and the like.

EXAMPLE

Next, the present invention will be described more specifically by way of examples, but the present invention is not limited to the examples. In the examples, "parts" and "%" represent "parts by mass" and "mass %" respectively, unless otherwise noted.

In addition, Non-slipping property, cushioning property, and an abrasion resistance test assuming collision with the ground such as in dribbling in the following examples and comparative examples were evaluated as described below.

[Non-Slipping Property]

Whether a ball of the present invention is slippery or not compared with a conventional basketball (Comparative Example 1) was evaluated by 10 arbitrarily selected basketball players.

[Cushioning Property]

Whether impact in catching a ball of the present invention is stronger or weaker compared with that a conventional basketball (Comparative Example 1) was evaluated by 10 arbitrarily selected basketball players.

[Abrasion Resistance Test Assuming Collision with Ground Such as in Dribbling]

A ball was thrown at plywood 1.6 m away at a speed of 37 km/hour and an angle of incidence of 60° for 20,000 times, and then a surface state of the ball was observed and evaluated as described below;

Level causing no problems in practical use: no surface peel and no significant dirt observed Level causing problems in practical use: surface peel or significant dirt in a vicinity of an air filling port or ball surface observed

Example 1

Nylon-6 (island component) and high-fluidity low-density polyethylene (sea component) were melt-spun into sea/island mix-spun fibers (sea component/island component ratio=50/50). The obtained fibers were drawn, crimped, and then cut into 51 mm long staples each having a fineness of 4.0 dtex. The staples were carded and formed into a web through a cross-lapping method to be laminated in a predefined number. A stack of webs was needle-punched at a needling density 980 P/cm$^2$ by using single-barbed felt needles, to thereby obtain a nonwoven fabric having a mass per unit area of 450 g/m$^2$. The nonwoven fabric was dried under heating, pressed to smooth its surface, and impregnated with a 16% dimethylformamide (hereinafter, referred to as "DMF") solution of polyether-based polyurethane, followed by the coagulation of the impregnated polyurethane in an aqueous solution of DMF to obtain a porous material. Then, the nonwoven fabric was washed with hot water to remove DMF, and polyethylene in the fibers was extracted and removed by hot toluene, to thereby obtain a synthetic leather-like base fabric formed of nylon-6 microfine fibers and porous polyurethane and having a thickness of 1.2 mm.

A DMF solution (solid content: 20%) of polyether-based polyurethane (MP-105, available from Dainippon Ink & Chemicals, Inc.) was applied onto the surface of the synthetic leather-like base fabric in an amount of 400 g/m$^2$ in accordance with the knife coating method and coagulated in water, to thereby form a polymer layer in a porous form. The polymer layer was colored with an ether-based polyurethane ink containing a brown pigment by transcription in accordance with the gravure method and drying, and was embossed at a temperature of 170° C., a pressure of 10 kg/cm, and an emboss speed of 1 m/minute by using an emboss roller having hemispherical protrusions each with a height of 1 mm and a projected area from an upper surface of 8 mm$^2$, to thereby obtain a cover layer. The obtained pattern of protrusions and depressions had comparable height differences between the continuous protrusions and hemispherical depressions adjoining the protrusions at any position, and an average height difference of 400 μm. The obtained pattern had comparable vertical projected areas of depressions, that is, projected areas of depressions from the upper surfaces which are perpendicular to the sheet surface for any depression, and an average vertical projected area of 7 $mm^2$. Further, the depressions had an average distance of 1.5 mm between them and the total area of the projected areas of the depressions accounted for 40% of the projected area of the entire sheet.

Next, the only upper surfaces of the resultant protrusions were colored by transcripting, in accordance with a gravure method, an ether-based polyurethane ink prepared by adding to an ink colored in advance carbon black to change a color tone of the ink to a darker (black) color, and dried, which resulted in a different color tone of the protrusions from that of the depressions. Thereafter, an ether-based polyurethane ink comprising a matting agent but no coloring agent was applied to the protrusions only by transcription in accordance with the gravure method and dried. Thus, the gloss of the upper portion of the protrusions was made milder, and the brighter gloss of the depressions was emphasized.

A ball for basketball was prepared using the sheet material obtained above and having leather-like appearance and feel as the surface material. The prepared ball exhibited the excellent three dimensional feel which was obtained by emphasizing the three dimensional shape on the surface having the protrusions and the depressions by the differences in the gloss and the color tone between the protrusions and the depressions. When the ball was used in the basketball game, the ball exhibited the non-slipping property more excellent than that of a conventional ball (Comparative Example 1) since the three dimensional shape of the surface fitted the finger tips. The impact to the finger tip at the time of catching the ball was decreased to a great degree in comparison with that of the conventional ball. Therefore, the ball exhibited the properties advantageous as the ball not only for adults but also for children having underdeveloped finger tips, which could not be achieved with conventional balls for basket ball. As the result of the use for a long time and the test of abrasion resistance simulating the case in which the ball hit the ground such as dribble, it was found that the surface of the sheet material did not show much abrasion, the shape having the protrusions and the depressions and the appearance remained in the level causing no problems in practical applications, and the excellent non-slipping property was maintained.

Example 2

A DMF solution (solid content: 7%) of polycarbonate-based polyurethane (U-5811, available from Seikoh Chem. Co., Ltd.) as a resin providing non-slipping property was applied in 2-stages onto protrusions on the surface of the sheet produced in Example 1 having colored upper surfaces by using a gravure roll of 150 mesh, followed by drying at 130° C.

A ball for basketball was produced by using the thus-obtained sheet material in the same manner as in Example 1 and used. As a result, the ball of Example 2 had three dimensional feel and a cushioning property comparable to those of Example 1 and better non-slipping property than that of Example 1, and had further excellent properties for children generally having lower grip strength than adults.

Example 3

A sheet was obtained in the same manner as in Example 1 except that: the height differences between the continuous protrusions and hemispherical depressions adjoining the protrusions were comparable at any position, and an average height difference was 80 μm; vertical projected areas of depressions, that is, projected areas of depressions from the upper surfaces which are perpendicular to the sheet surface were comparable for any depression, and an average vertical projected area was 4 $mm^2$; an average distance between the depressions was 2.5 mm; and the total area of the projected areas of the depressions accounted for 31% of the projected area of the entire sheet.

Next, a ball for basketball was prepared in the same manner as in Example 1 by using the obtained sheet material having leather-like appearance and feel as the taste as the surface material, and was used in a basketball game. As a result, the ball had excellent non-slipping property compared with that of a conventional ball for basketball (Comparative Example 1) due to catching of the protrusions. Further, as cushioning property of the protrusions, the ball had significantly reduced impact on fingertips in catching of a ball compared with that of the conventional ball. The ball had appropriate properties for adults as well as for children having undeveloped fingertips, in particular, which could not be realized with the conventional ball. Further, the ball kept the favorable non-slipping property even after use over a long period of time.

Example 4

A sheet was obtained in the same manner as in Example 1 except that: height differences between the continuous protrusions and hemispherical depressions adjoining the protrusions were comparable at any position, and an average height difference was 850 μm; vertical projected areas of depressions, that is, projected areas of depressions from the upper surfaces which are perpendicular to the sheet surface were comparable for any depression, and an average vertical projected area was 25 $mm^2$; and an average distance between the depressions was 0.7 mm.

Next, a ball for basketball was prepared in the same manner as in Example 1 by using the obtained sheet material having leather-like appearance and feel as the taste as the surface material, and was used in a basketball game. As a result, the ball had excellent non-slipping property compared with that of a conventional ball for basketball (Comparative Example 1) due to catching of the protrusions. Further, as cushioning property of the protrusions, the ball had significantly reduced impact on fingertips in catching of a ball compared with that of the conventional ball. The ball had appropriate properties for adults as well as for children having undeveloped fingertips, in particular, which could not be realized with the conventional ball. Further, the ball kept the favorable non-slipping property even after use over a long period of time.

Comparative Example 1

A sheet was produced in the same manner as in Example 1 except that an emboss roller was used to provide a pattern of protrusions and depressions generally used for a basketball, that is: a diameter of about 1.8 mm, numerous hemispherical protrusions with a height difference of about 200 μm at a distance about of 0.5 mm; and without substantially continuous protrusions.

A ball for basketball having the thus-obtained sheet on a surface was produced, and was used. The ball had poor cushioning property and had large impact on fingertips in catching of the ball even though the ball had appearance of a three dimensional feel which is familiar and different from that of the ball of Example 1. The ball could be used by adults but was not appropriate for children, and was slippery compared to the ball of Example 1.

Comparative Example 2

A sheet material was obtained in accordance with the same procedures as those conducted in Example 1 except that none of the ink for providing a color tone different from that of the depressions and the ink for providing a gloss different from that of the depressions was applied to the continuous protrusions on the surface of the sheet. When a ball for basketball was prepared using the obtained sheet material for the surface, the ball exhibited a monotonous appearance due to little variation in the color and was lacking in the three dimensional feel and high grade feel although the shape having protrusions and depressions could be confirmed easily.

Comparative Example 3

A sheet material was obtained in accordance with the same procedures as those conducted in Example 1 except that the speed of embossing was 4 m/min, the height difference between the continuous protrusion and the depression adjoining the protrusion was 30 μm, and the vertical projected area of the depression was 2.5 $mm^2$. When a ball for basketball was prepared using the sheet material for the surface and used for the game, the cushioning property was poor, and the impact at the finger tip at the time of catching the ball was as great as that in Comparative Example 1. Therefore, the ball was not suitable for use by children although the ball could be used by adults. The ball was slippery than the ball in Example 1.

Comparative Example 4

A sheet material was obtained in accordance with the same procedures as those conducted in Example 1 except that the vertical projected area of the depression adjoining the continuous protrusion was 50 $mm^2$. When a ball for basketball was prepared using the sheet material for the surface and used for the game, the result of the test of abrasion resistance simulating the case in which the ball hit the ground such as dribble was clearly inferior to that in Example 1, indicating that the ball was at the level causing problems in practical use, although the cushioning property was reasonably good. The ball was slippery than the ball in Example 1.

Comparative Example 5

A sheet material was obtained in accordance with the same procedures as those conducted in Example 1 except that the average distance between the depressions adjoining the continuous protrusions was 0.4 mm. When a ball for basketball was prepared using the sheet material for the surface and used for the game, the softness, the cushioning property and the feel of touch were poor, and the result of the test of abrasion resistance simulating the case in which the ball hit the ground such as dribble was at the level causing problems in practical use, although the non-slipping property was reasonably good.

Comparative Example 6

A sheet material was obtained in accordance with the same procedures as those conducted in Example 1 except that the average distance between the depressions adjoining the continuous protrusions was 3.7 mm. When a ball for basketball was prepared using the sheet material for the surface and used for the game, the fitting property and the non-slipping property were poor although the result of the test of abrasion resistance simulating the case in which the ball hit the ground such as dribble was at the level causing no problems in practical use and the softness was good. The ball was slippery than the ball in Example 1.

Comparative Example 7

A sheet material was obtained in accordance with the same procedures as those conducted in Example 1 except that the depression adjoining the continuous protrusion had a cylindrical shape. When a ball for basketball was prepared using the sheet material for the surface and used for the game, the softness, the cushioning property and the feel of touch were poor, and the result of the test of abrasion resistance simulating the case in which the ball hit the ground such as dribble was at the level causing problems in practical use although the non-slipping property was reasonably good.

Comparative Example 8

A sheet material was obtained in accordance with the same procedures as those conducted in Example 1 except that the depression adjoining the continuous protrusion had a hexagonal peripheral shape. When a ball for basketball was prepared using the sheet material for the surface and used for the game, the softness, the cushioning property and the feel of touch were poor, and the result of the test of abrasion resistance simulating the case in which the ball hit the ground such as dribble was at the level causing problems in practical use although the non-slipping property was reasonably good.

INDUSTRIAL APPLICABILITY

The sheet material of the present invention can be advantageously used for balls which are brought into direct contact with hands such as balls for basketball, handball, rugby, American football and the like, and also for grip tapes for tennis racquets and badminton racquets and surface covers for steering wheels for vehicles, holding straps and handrails of staircases.

The invention claimed is:

1. A sheet material comprising a base fabric and a coating layer of a polymer covering a surface of the base fabric, wherein the coating layer has substantially continuous protrusions and hemispherical depressions formed adjoining the protrusions on a surface, the depressions have a color tone different from a color tone of the protrusions and a gloss brighter than a gloss of the protrusions, a vertical projected area of each of the depressions is 3 to 30 $mm^2$, an average distance between the depressions is 0.5 to 3 mm, and a height difference between the protrusion and the depressions is 50 to 1,000 μm.

2. The sheet material according to claim 1, wherein the base fabric is a knitted fabric or woven fabric or a nonwoven fabric.

3. The sheet material according to claim 1, wherein a fiber constituting the base fabric is a microfine fiber having an average fineness of 0.0001 to 0.3 dtex.

4. The sheet material according to claim 3, wherein the microfine fiber is obtained via a sea/island fiber and/or a multi-layered fiber.

5. The sheet material according to claim 4, wherein a ratio of amounts by volume of a sea component to an island component in the sea/island fiber is in the range from 30/70 to 70/30.

6. The sheet material according to claim 1, wherein the base fabric is a base fabric comprising a fiber-entangled fabric and a polymer.

7. The sheet material according to claim 1, wherein the base fabric is a three-dimensionally entangled nonwoven fabric impregnated with a polymer at an inside thereof.

8. The sheet material according to claim 1, wherein the polymer is a polyurethane-based resin.

9. The sheet material according to claim 1, wherein a total area of vertical projected areas of the depressions is 30 to 60% of a surface area of the sheet material.

10. The sheet material according to claim 1, wherein at least a part of a surface of the protrusions or a surface of the depressions are coated with a resin having a non-slipping property.

11. The sheet material according to claim 1, wherein a fiber constituting the base fabric is a microfine fiber having sea/island structure.

12. The sheet material according to claim 11, wherein the sea/island volume ratio is 30/70 to 70/30.

13. The sheet material according to claim 11, wherein the sea/island volume ratio is 40/60 to 60/40.

14. The sheet material according to claim 1, wherein a total area of vertical projected areas of the depressions is 40 to 50% of a surface area of the sheet material.

15. The sheet material according to claim 1, wherein average distance between the depressions is 1 to 2 mm.

16. The sheet material according to claim 1, wherein the height difference between the protrusion and the depressions is 70 to 500 μm.

17. The sheet material according to claim 1, wherein the vertical projected area of each of the depressions is 5 to 20 $mm^2$.

* * * * *